United States Patent [19]

McDonough

[11] 3,964,069

[45] June 15, 1976

[54] CONSTANT BEAMWIDTH ANTENNA

[75] Inventor: Robert J. McDonough, Ventura, Calif.

[73] Assignee: Raytheon Company, Lexington, Mass.

[22] Filed: May 1, 1975

[21] Appl. No.: 573,697

[52] U.S. Cl. ..... 343/754; 343/854

[51] Int. Cl.[2] ..... H01Q 19/06

[58] Field of Search ..... 343/754, 854, 909

[56] References Cited

UNITED STATES PATENTS 3,314.071 4/1967 Lader et al. ..... 343/840

*Primary Examiner*—Eli Lieberman

*Attorney, Agent, or Firm*—Richard M. Sharkansky; Philip J. McFarland; Joseph D. Pannone

[57] ABSTRACT

An antenna assembly for radio frequency energy is disclosed wherein individual antenna elements making up an array are fed in an improved manner so that the width of a directive beam, or beams, formed by such elements is, or are, maintained substantially constant over a wide band of operating frequencies. The antenna assembly includes a printed circuit lens having a plurality of feedports coupled to a like plurality of the antenna elements through different constrained electrical paths. The desired operating characteristic is attained by disposing radio frequency energy absorbing material of varying length in the constrained electrical paths, to selectively attenuate radio frequency energy to the antenna elements as operating frequency is changed, with the result that the width of the beam, or beams, radiated from the array of antenna elements remains substantially constant over a wide band of operating frequencies.

3 Claims, 4 Drawing Figures

CONSTANT BEAMWIDTH ANTENNA

BACKGROUND OF THE INVENTION

This invention pertains generally to directive antennas for radio frequency energy and particularly to wide-band directive antennas for radio frequency energy.

It is known in the art that an array of antenna elements may be fed through a parallel plate lens, i.e. a "microwave" lens, and a plurality of transmission lines in such a manner than one, or more, beams of radio frequency energy are formed. With proper design, such an assembly may be operative over a wide band of frequencies, say an octave band. Because the principle of reciprocity applies, such an antenna assembly is also adapted to receive radio frequency energy within the same frequency band from one, or more, directions.

In one known antenna assembly of the type just mentioned, a design defining a linear array of antenna elements, transmission lines, microwave lens and a plurality of feedports are formed on a common dielectric substrate using printed circuit techniques. After the so printed dielectric substrate is assembled in operative relationship with one or two ground planes (depending upon whether a microstrip or a stipline assembly is desired), constrained paths in the dielectric substrate are defined for radio frequency energy within a relatively wide frequency band. The dimensions of, and spacing between, the various parts of the printed design determine the characteristics of the completed antenna assembly. In particular, with a plurality of feedports along a focal arc, the printed design is so arranged that the electrical lengths of the paths between each feedport and the antenna elements are systematically controlled. When all of the feedports are energized, the phase shifts experienced by radio frequency energy passing from each feedport to the antenna elements are such that a plurality of simultaneously existing beams of radio frequency energy is formed, each pointing in a different direction. The same antenna assembly may be operated to form a single one of the beams by simply energizing a single one of the feedports. While such an antenna is adapted to operation over a wide band of frequencies, experience has proven that the beamwidth of its radiated beam, or beams, varies inversely with frequency.

While a variation in beamwidth due to a change in operating frequency may be tolerated in many applications, cases exist where such a variation seriously affects proper performance. For example, if (when the antenna assembly is to produce a plurality of simultaneously existing beams) it is desired to maintain the power level at the crossover point between adjacent beams, any variation in beamwidth due to a change in operating frequency obviously should be avoided. Similarly, if (when the antenna assembly is to produce a single beam) it is desired to reduce clutter when a beam is pointed so as to graze an extended area, as the sea or a land mass, it is also obvious that any variation in beamwidth due to a change in operating frequency should be avoided.

One technique described in pending patent application Ser. NO. 442,704 filed 2/15/74, inventor W. B. Hatch, assigned to the assignee of the present invention, provides a "constant beamwidth antenna" wherein an array of antenna elements is disposed to form at least one directive beam, by providing attenuator means in circuit with selected ones of the antenna elements in such an array, individual ones of such attenuator means having frequency response characteristics such that the amplitude taper of the electromagnetic energy across the array is varied as the operating frequency is changed. The attenuator means comprises a number of low pass filters having different cutoff frequencies within a band of operating frequencies, such filters being disposed in circuit with selected antenna elements so that, as operating frequency is increased, the number of energized antenna elements is decreased to maintain the size of the effective aperture of the array at a substantially constant size, measured in wavelengths. While such an antenna assembly has been found adequate in many applications, the antenna assembly of the present invention is an improvement thereon because the contemplated assembly may be constructed more simply and inexpensively than such known antenna assembly.

SUMMARY OF THE INVENTION

With this background of the invention in mind it is an object of this invention to provide an improved, simpler and less expensive antenna assembly adapted to produce one, or more, beams of radio frequency (or electromagnetic) energy, such beam, or each one of such beams, having a beamwidth which is substantially invariant over a wide band of operating frequencies.

This and other objects of the invention are obtained generally by providing, in an antenna assembly for producing a plurality of directive beams of electromagnetic energy, a printed circuit lens having a plurality of feedports coupled to the antenna elements in the array through constrained electrical paths, and wherein frequency dependent attenuator means are included for varying, in accordance with the frequency of the electromagnetic energy, the amplitude of such electromagnetic energy in such constrained paths, the improvement characterized by such frequency dependent attenuator means including radio frequency energy absorbing material disposed in portions of the constrained electrical paths the physical size of such material varying progressively in accordance with the frequency-amplitude variation of such frequency dependent attenuator means.

In a preferred embodiment the absorbing material is deposed between the lens and a ground plane thereof, the length of absorbing material in such paths varying so that, as operating frequency is increased, the number of energized antenna elements is decreased to maintain the size of the effective aperture of the array at a substantially constant size.

BRIEF DESCRIPTION OF THE DRAWINGS

For a more complete understanding of this invention, reference is now made to the following description of the accompanying drawings wherein.

DESCRIPTION OF THE PREFERRED EMBODIMENTS

Figure 1:
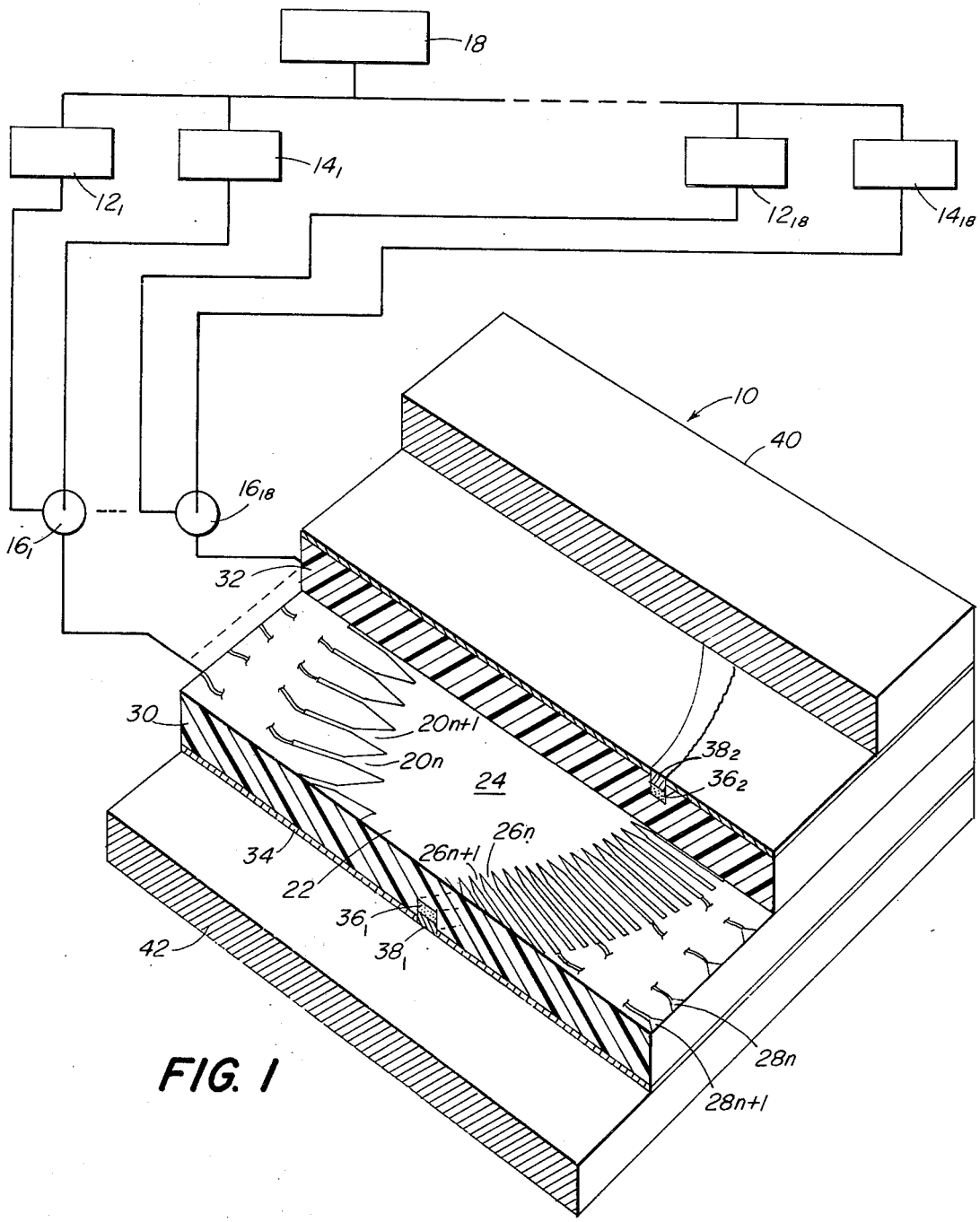
FIG. 1 is a diagram, greatly simplified, of an antenna assembly according to this invention showing the manner in which such an assembly is related to transmitters and receivers in a system, the illustrated antenna assembly being partially broken away and exploded to show details of construction of such assembly.

Referring now to FIG. 1, an antenna assembly 10 is shown connected in a conventional manner to a plurality, here 18, of transmitters $\mathbf{12_1}$–$\mathbf{12_{18}}$ and a like plurality of receivers $\mathbf{14_1}$–$\mathbf{14_{18}}$ through, respectively, transmit/-receive switches $\mathbf{16_1}$–$\mathbf{16_{18}}$. The various transmitters and receivers are synchronized by a common system synchronizer 18 of conventional design. Each one of the transmit/receive switches $\mathbf{16_1}$–$\mathbf{16_{18}}$ is connected to a different one of 18 feedports (such as the feedports indicated by $\mathbf{20}_n$, $\mathbf{20}_{n+1}$) through lines (not numbered).

Figure 2:
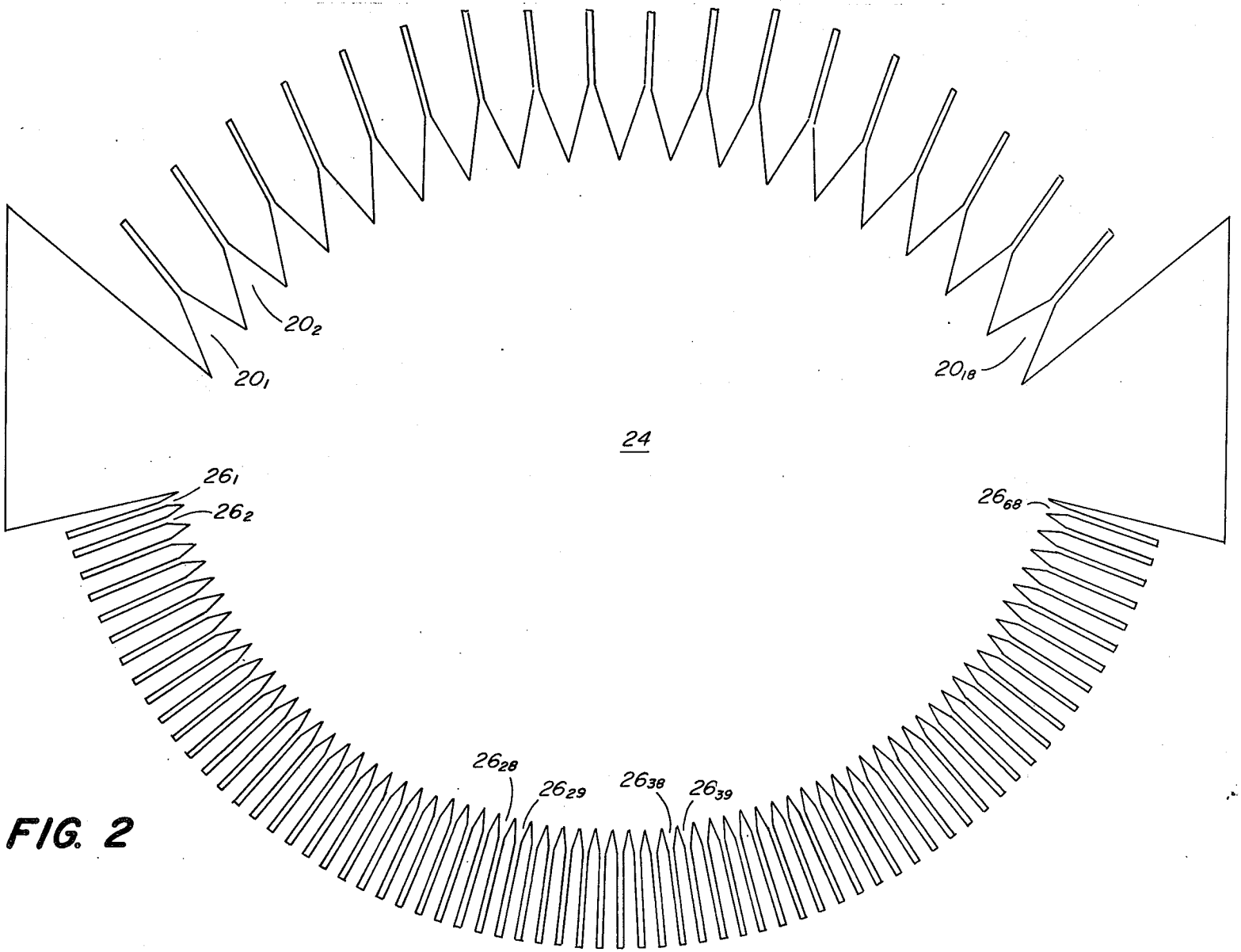
FIG. 2 is a plan view of a dielectric substrate of the antenna assembly of FIG. 1 showing a microwave lens printed thereon and used in such antenna assembly.

It is here noted that the antenna assembly 10 is here a stripline circuit including, as strip center conductor 22, an irregular geometrically shaped printed circuit microwave lens 24, and feedports $\mathbf{20}_n$, $\mathbf{20}_{n+l}$, disposed along a focal arc and contiguous with such microwave lens 24. The latter in turn is connected through matching sections (not numbered) to a plurality (here 68) of transmission lines (such as the lines marked $\mathbf{26}_n$, $\mathbf{26}_{n+1}$) to define constrained paths for electromagnetic energy to each one of the antenna elements (such as those marked $\mathbf{28}_n$, $\mathbf{28}_{n+1}$). The strip center conductor 22 is etched on one side of a dielectric slab 30, such slab 30 initially being copper clad on both sides thereof. The layout of such lens 24 is shown in FIG. 2

Referring again to FIG. 1 a second dielectric slab 32 is shown, such slab having copper clad on the upper side thereof, the lower (non copper clad) side being in contact with the strip center conductor 22 of the antenna assembly 10. It is here noted that, for reasons to become apparent, the lower side of dielectric slab 30, (side 34) and the upper copper clad side of dielectric slab 32 have inlaid therein radio frequency energy absorbing material $\mathbf{36_1}$, $\mathbf{36_2}$, here a silicon rubber called "SF-5" manufactured by Emerson & Cuming, Inc., Canton, Mass. 02021. Disposed over such absorbing material $\mathbf{36_1}$, $\mathbf{36_2}$ is a conductive material, here a silver loaded gasket material, $\mathbf{38_1}$, $\mathbf{38_2}$ called "Cho-Seal 1221" manufactured by Chomerics, Inc., Arlington, Mass. When assembled then a stripline circuit is formed with the copper clad sides of the dielectric slabs 30, 32 and the silver loaded gasket material $\mathbf{38_1}$, $\mathbf{38_2}$ serving as the ground planes for the strip center conductor 22. Completing the antenna assembly 10 a pair of aluminum blocks 40, 42 are provided to add structural support to the assembly. The assembly 10 is held together in any convenient manner here by screws not shown. For reasons discussed in detail in U.S. Pat. No. 3,761,936 entitled "MultiBeam Array Antenna," issued Sept. 25, 1973, directive beams of electromagnetic energy then are formed, when all of the transmitters $\mathbf{12_1}$–$\mathbf{12_{18}}$ are energized as such energy propagates through the antenna assembly in the TEM mode.

Figure 4:
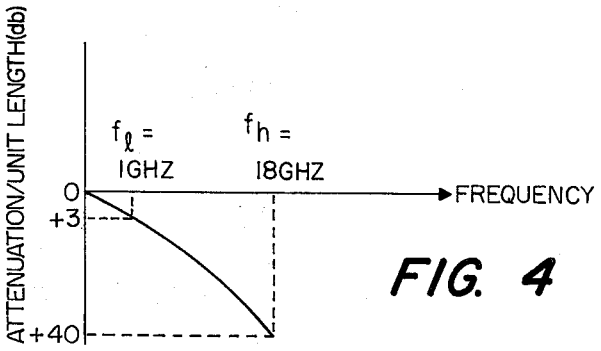
FIG. 4 is a curve showing generally the attenuation-frequency characteristic of the absorbing material.
Figure 3:
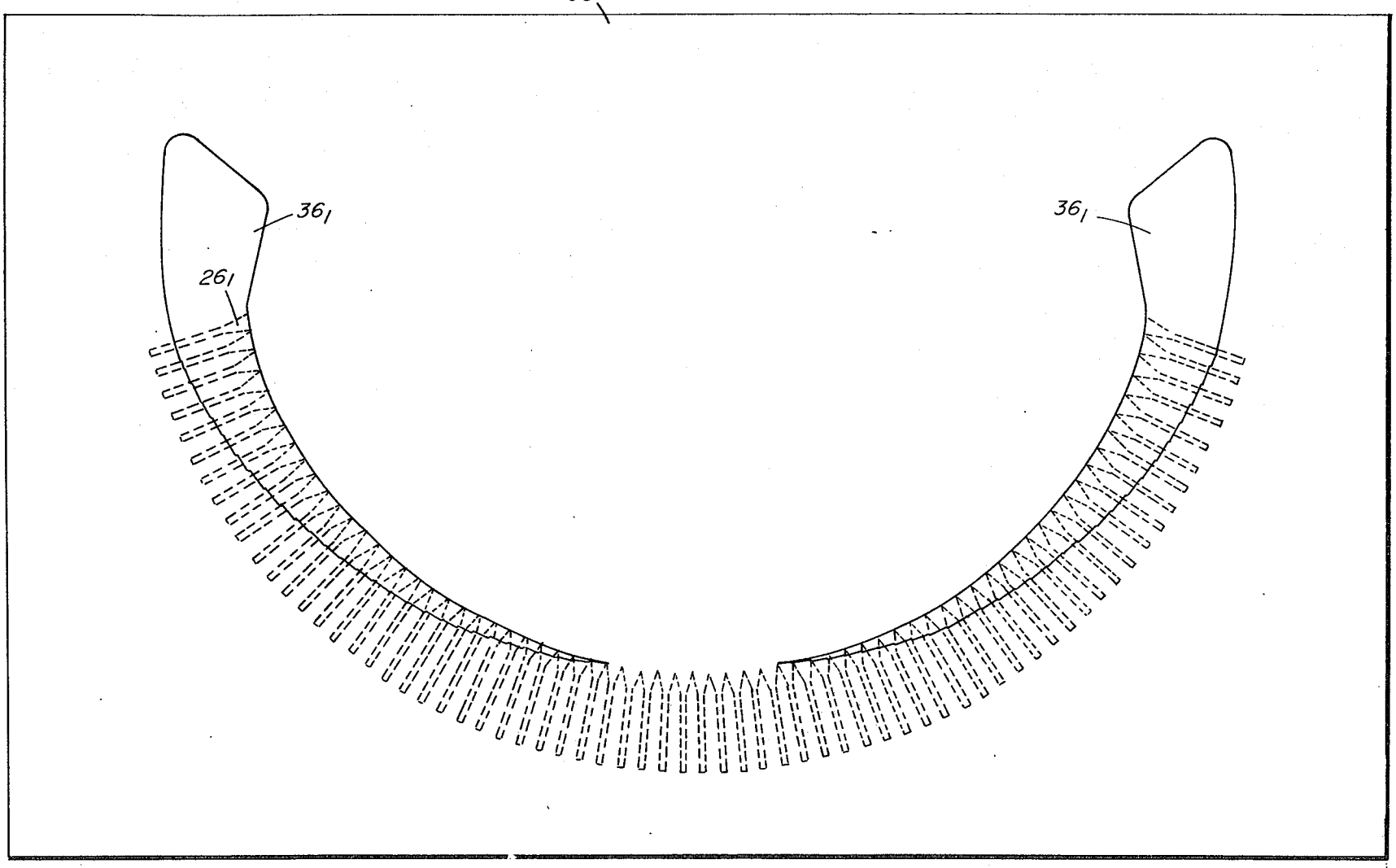
FIG. 3 is a plan view of one of a pair of dielectric substrates having an absorbing material inlaid therein and showing the configuration of such inlaid absorbing material and the relationship thereof with the constrained electrical paths between the microwave lens and radiating elements.

Referring now to FIG. 3 a layout showing the absorbing material inlaid in one of the dielectric slabs 30, 32, here dielectric slab 30, is shown. (It is here noted that the layout of the absorbing material $\mathbf{36_1}$ inlaid in dielectric slab 32 is equivalent to that shown in FIG. 3.) Also shown with dotted lines in FIG. 3 are the transmission lines $\mathbf{26_1}$–$\mathbf{26_{68}}$. It is first pointed out that the absorbing material $\mathbf{36_1}$ has a frequency-attenuation characteristic of the type shown in FIG. 4. As shown, attenuation through a given length of the absorbing material increases with frequency.

Referring back to FIG. 3, it will be observed that as the operating frequency is increased from $f_1$, the amount of radio frequency energy reaching the antenna elements centrally located in the array 10 (i.e. those antenna elements coupled via transmission lines $\mathbf{26_{29}}$–$\mathbf{26_{38}}$) is always the same. As the operating frequency is increased, however, the amount of radio frequency energy reaching the antenna elements on the edges of the array (i.e. those antenna elements coupled via transmission lines $\mathbf{26_1}$–$\mathbf{26_{28}}$ and $\mathbf{26_{39}}$–$\mathbf{26_{68}}$) decreases. With the absorbing material $\mathbf{36_1}$, patterned as shown in FIG. 3, the effective size of the aperture defined by energized elements here decreases as the operating frequency changes from $f_1$ to $f_h$. To put it another way, the size of the aperture, expressed in wavelengths, remains substantially constant when the operating frequency is changed from $f_1$ to $f_h$. Further it should be noted that the different feedports may, at any instant in time, be energized by radio frequency energy of different frequencies.

Having described one embodiment of this invention, it will now be clear to one of skill in the art that many changes may be made without departing from the inventive concepts disclosed herein. For example, the number of antenna elements and feedports may be changed. Further the absorbing materials $\mathbf{36_1}$, $\mathbf{36_2}$ of different attenuation-frequency characteristics may be used in connection with different transmission lines in addition to having the lengths of such materials vary for the various transmission lines associated therewith. It is felt, therefore, that this invention should not be restricted to its disclosed embodiments, but rather should be limited only by the spirit and scope of the following claims.

It is claimed that:

1. In an antenna assembly for producing a plurlity of directive beams of electromagnetic energy, a printed circuit lens having a plurality of feedports coupled to the antenna elements in the array through constrained electrical paths, and wherein frequency dependent attenuator means are included for varying, in accordance with the frequency of the electromagnetic energy, the amplitude of such electromagnetic energy in such constrained paths, the improvement characterized by such frequency dependent attenuator means including a radio frequency energy absorbing material disposed in portions of the constrained electrical paths the physical size of such material varying progressively in accordance with the frequency-amplitude variation of such frequency dependent attenuator means.

2. The improvement recited in claim 1 wherein such printed circuit lens has a ground plane electrically associated therewith and wherein such radio frequency energy absorbing material is disposed between the printed circuit lens and the ground plane.

3. The improvement recited in claim 2 wherein the printed circuit lens is formed on one side of a dielectric substrate and a portion of the ground plane is formed on the other side of the dielectric substrate and wherein the radio frequency energy absorbing material is inlaid into the dielectric substrate, and including a conductive material disposed over such inlaid dielectric material to form another portion of the ground plane.

* * * * *